US008711659B2

(12) United States Patent
Lauper et al.

(10) Patent No.: US 8,711,659 B2
(45) Date of Patent: Apr. 29, 2014

(54) SEQUENTIAL CONTROL DEVICE FOR A STRIKING MECHANISM

(75) Inventors: Simon Lauper, Le Solliat (CH); Jean-François Pesenti, Morbier (FR)

(73) Assignee: Montres Breguet SA, L'Abbaye (CH)

( * ) Notice: Subject to any disclaimer, the term of this patent is extended or adjusted under 35 U.S.C. 154(b) by 519 days.

(21) Appl. No.: 13/041,829

(22) Filed: Mar. 7, 2011

(65) Prior Publication Data

US 2011/0216632 A1 Sep. 8, 2011

(30) Foreign Application Priority Data

Mar. 5, 2010 (EP) ..... 10155664

(51) Int. Cl.
*G04B 21/06* (2006.01)

(52) U.S. Cl.
USPC ..... 368/203; 368/267; 368/220; 368/206

(58) Field of Classification Search
USPC ..... 368/75, 98, 99, 100, 206, 244, 267, 269
See application file for complete search history.

(56) References Cited

U.S. PATENT DOCUMENTS 7,292,505 B2 * 11/2007 Schmiedchen ..... 368/110
8,000,174 B2 * 8/2011 Rochat et al. ..... 368/267

FOREIGN PATENT DOCUMENTS

CH 633 376 8/1977
CH 604 237 B5 8/1978

OTHER PUBLICATIONS

Reymondin C A et al., :Theorie d'horologie, La repetitions a minutes, Jan. 1, 1998, Theorie D'Horlogerie, Federations des Exoles Tehcniques de Suisse, Lausanne., pp. 219-223.
Lecoultre, François, "Les montres compliquées" (Complicated Watches) (ISBN 2-88175-000-1) (pp. 97 to 205).
Search Report issued in corresponding application EP 10 15 5664, completed Aug. 30, 2010.

* cited by examiner

*Primary Examiner* — Amy Cohen Johnson
*Assistant Examiner* — Jason Collins
(74) *Attorney, Agent, or Firm* — Griffin & Szipl, P.C.

(57) ABSTRACT

The invention concerns a mechanical device (100) for the sequential control of at least two levers for a timepiece mechanism, controlling a first lever (1) and a second (2) lever cooperating with a contact surface (10) in accordance with a sequence wherein each changes from a first torque consumption level (11; 21) to a second, higher level (12; 22) during an increasing phase (14; 24) in which it stores torque, then from said second level (12; 22) to said first level (11; 21) during a decreasing phase (15; 25) in which it transmits energy.
The device is wherein it includes delaying means (4) creating, during the decreasing phase (15) of said first lever (1), a stabilizing stage at a third, intermediate level (13) between said first (11) and second (12) levels.
The invention also concerns a timepiece incorporating a device (100) of this type.

17 Claims, 5 Drawing Sheets

SEQUENTIAL CONTROL DEVICE FOR A STRIKING MECHANISM

This application claims priority from European Patent Application No. 10155664.5 filed Mar. 5, 2010, the entire disclosure of which is incorporated herein by reference.

FIELD OF THE INVENTION

The present invention concerns a mechanical sequential control device for at least two levers of a timepiece mechanism, which includes motor means and release means for controlling the actuation of at least a first lever and a second lever, which are each arranged to cooperate with a path of a contact surface of said device. Said contact surface is movable via the action of motor means for transmitting energy to said levers in the form of torque, in a sequence imposed by said paths, wherein each of the levers changes in succession from a first torque consumption level to a second torque consumption level, which is higher than said first level, during a first, increasing phase, in which said lever stores energy, then from said second level to said first level during a second, decreasing phase, in which said lever transmits energy to a mechanism using said energy. During said sequence, said first lever transmits all of the energy that it has accumulated to a mechanism using said energy before or after the moment at which said second lever transmits all of the energy that it has accumulated to a user mechanism.

The invention also concerns a striking mechanism, which includes at least one strike wheel using part of the energy provided by an energy source to actuate at least one hammer on at least one gong, via the action of a tooth or a cam comprised in said strike wheel on said hammer, and which includes at least one such control device.

The invention also concerns a timepiece including at least one such control device.

The invention relates to the field of mechanisms for timepieces, which use energy for acoustic or visual displays, such as, in particular, striking or date mechanisms.

BACKGROUND OF THE INVENTION

In particular, a recurring problem in striking mechanisms is the management of the energy source used for the actual strike work. In addition to a high level of energy consumption for winding the hammer(s), in some types of strike works, instantaneous peaks in torque consumption must also be dealt with, which often means that the energy sources have to be over-sized.

Timepieces with an improved strike work have been known for a long time, in particular in so-called complicated watches, such as repeater watches or grand strike watches. For a clear understanding of the state of the art in the field of complicated watches, reference may be made to the work of François Lecoultre entitled "Les montres compliquées" (*Complicated Watches*) (ISBN 2-88175-000-1), which includes, in particular, several chapters relating to watches fitted with a striking mechanism (pages 97 to 205).

CH Patent No. 604 237 in the name of Dubois & Depraz discloses a repeater watch with a strike device comprising two superposed gongs with different tones, struck by two hammers actuated by two ratchets that act via sets of wolf teeth on pivoting elements to move them against their respective strike spring. These ratchets are only toothed over one part of the circumference thereof, and their relative position determines the set of different strikes. The strike device includes a strike regulator for adjusting the speed of rate but it does not include any particular energy management means for avoiding peaks in power consumption.

SUMMARY OF THE INVENTION

The invention proposes to overcome the problem of peaks in torque consumption by providing a mechanical sequential control device for at least two levers of a timepiece mechanism, arranged to avoid peaks in the consumption of torque supplied by motor means, by cumulating the torque consumptions of each of the levers, which transmit energy received from the motor means via this device, in the form of torque, to one or more mechanisms using this energy, such as a striking, or date or other mechanism.

The invention therefore concerns a mechanical sequential control device for at least a first lever and a second lever of a timepiece movement, said first and second levers being arranged to control respectively the movement of a first wheel set and a second wheel set, against elastic return means, to make two movements that are close together in time and partially superposed, said control device including first means for winding said first wheel set and second means for winding said second wheel set, said control device being arranged to release said first and second wheel sets in succession and not simultaneously, wherein said first winding means includes means creating a time delay between the winding and the release of the movement of the first wheel set, arranged for holding potential energy accumulated in the mechanism for manoeuvring said first wheel set for a determined time period, so as to keep said first wheel set wound during said first determined time period until the release thereof, and also wherein said first winding means includes means of transmitting motor means, comprised in said timepiece mechanism or said control device, to a contact surface including a first path, for controlling said first lever, and on which there is arranged at least one delay surface forming said delaying means.

According to one feature of the invention, said first path is arranged at the periphery of a wheel, driven by motor means of said timepiece mechanism or by motor means comprised in said device, and said delaying means includes at least one delay surface, having an angular amplitude during which said first wheel set remains wound which is comprised between 15% and 25% of the angular amplitude corresponding to the complete cumulated winding and release cycle of said first wheel set and second wheel set, and/or is comprised between 25% and 40% of the angular amplitude corresponding to the cycle of winding and holding said first wheel set in the wound position.

According to one feature of the invention, said first path is arranged at the periphery of a wheel driven by motor means of said timepiece mechanism or by motor means comprised in said device, and said delaying means includes at least one delay surface, which consists of a substantially tangential surface to said wheel, and said delay surface having an arc length of between 6% and 10% of the largest radius of said wheel with which said first lever cooperates.

The invention also concerns a striking mechanism including at least one strike wheel using part of the energy provided by an energy source to actuate at least one hammer on at least one gong, via the action of a tooth or cam of said strike wheel on said hammer, and including at least one such control device, wherein said control device is a sequential strike control device, in that said first lever is a first strike lever, said second lever is a second strike lever of a timepiece mechanism, said first wheel set is a first hammer and said second wheel set is a second hammer, said first lever and second lever being arranged for respectively controlling the movement of said first hammer and said second hammer to strike two blows close together in time, and further wherein said contact surface is located at the periphery of a strike wheel, and the first lever and second lever are each arranged for actuating at least one hammer on at least one gong, by the action of as many teeth as said strike wheel has, and which, completed by intermediate pads having no contact with the first lever and second lever, constitute said surface contact.

The invention further concerns a date mechanism including a control device of this type, including delaying means that includes at least one delay surface on a contact surface which winds in succession at least a first lever and a second lever comprised in pivoting parts of said date mechanism, or which control the movement of such pivoting parts.

According to a feature of the invention, said date mechanism is an instantaneous date mechanism, which includes several pivoting parts wound in succession by different levers, and all the pivoting parts jump simultaneously.

The invention further concerns a timepiece including a timepiece mechanism, said timepiece mechanism including motor means and release means for controlling actuation of at least a first lever and a second lever, wherein it includes at least one such control device, for regulating the torque consumed by a strike mechanism or a minute repeater strike mechanism comprised in said timepiece, and/or for regulating the torque consumed by a date mechanism comprised in said timepiece.

The invention has the advantage of allowing minimal sizing of the energy sources such as barrels or suchlike, used for mechanisms such as striking mechanisms. It can also ensure, depending upon the particular case, either synchronisation between certain events, as in an instantaneous date mechanism, or the desired time lag as in a ding-dong strike, with the best possible management of energy. The invention allows the accumulated level of torque consumed by the complications to be kept at a reasonable level. The stresses exerted on the structure, notably on the plates, are consequently less, and the performance of the timepiece over time is improved. The fact that the cumulated torque consumption curve is smoothed out has a direct influence on the adjustments, which are thereby greatly facilitated.

BRIEF DESCRIPTION OF THE DRAWINGS

Other features and advantages of the present invention will appear more clearly from the following detailed description of an example embodiment of the correction mechanism according to the invention, this example being given solely by way of non-limiting illustration with reference to the annexed drawing, in which.

DETAILED DESCRIPTION OF PREFERRED EMBODIMENTS

Figure 1:
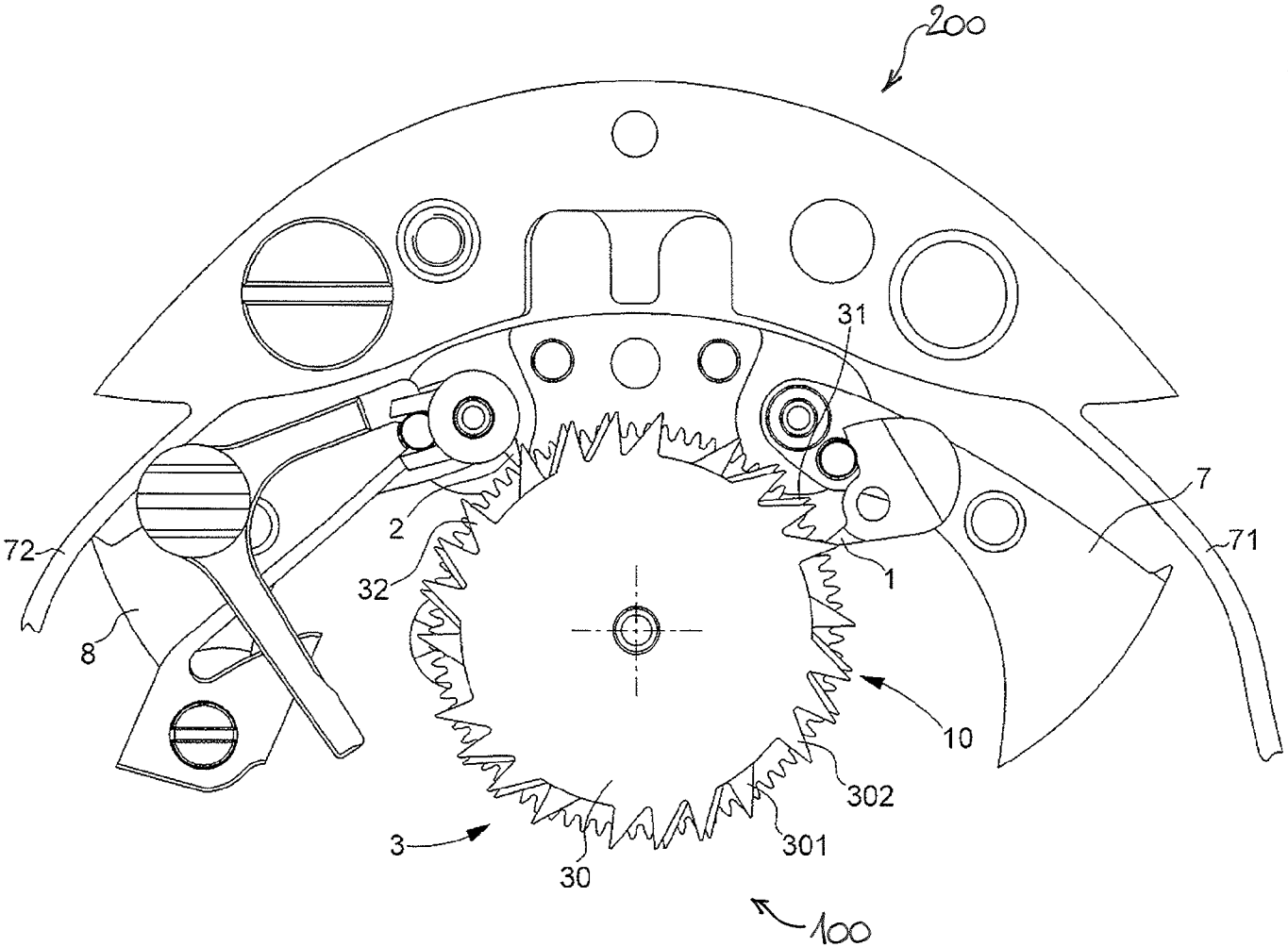
FIG. 1 is a partial schematic plan diagram of a striking mechanism for a timepiece including a strike wheel with two paths of pointed teeth, to actuate two levers each actuating a hammer to strike a gong, and perform ding-dong strikes in sequence.

The invention relates to the field of timepiece mechanisms, which consume energy for acoustic or visual displays, such as, in particular, striking or date mechanisms.

The invention concerns a mechanical control device 100 for the sequential control of at least a first lever 1 and a second lever 2 of a timepiece mechanism.

This timepiece mechanism is of the type that includes motor means, such as a barrel or similar, and release means 3 for controlling actuation of at least a first lever 1 and a second lever 2, which are arranged for transmitting energy, received from the motor means via control device 100, to a mechanism using such energy.

This first lever 1 and second lever 2 are arranged for respectively controlling the movement of a first wheel set 7 and a second wheel set 8 to make, preferably against elastic return means, two movements that are close together in time and partially superposed.

This description is illustrated in the case where two levers are actuated, but it is clear that the invention applies in exactly the same way where the number of levers is higher than two.

Control device 100 includes first means for winding first wheel set 7 and second means for winding second wheel set 8. This control device 100 is arranged to release first wheel set 7 and second wheel set 8 in succession and not simultaneously.

According to the invention, said first winding means includes means 4 for delaying the time between the winding and the release of the movement of first wheel set 7, arranged for keeping potential energy accumulated in the mechanism for manoeuvring first wheel set 7 for a predetermined period of time, so as to keep first wheel set 7 wound during this predetermined period until the release thereof.

According to the invention, this delaying means 4 includes at least one delay surface 40.

According to another feature, this first winding means includes means for transmitting motor means, comprised in the timepiece mechanism or control device 100, to a contact surface 10 including a first path 301, for controlling said first lever 1, and on which there is arranged at least one delay surface 40 forming delaying means 4.

In a preferred embodiment, as illustrated in the Figures, the first path 301 is arranged at the periphery of a wheel 30 driven by motor means of the timepiece mechanism or comprised in control device 100, and delaying means 4 includes at least one delay surface 40, which has an angular amplitude, during which said first wheel set 7 remains wound, which is comprised between 15% and 25% of the angular amplitude corresponding to the complete cumulated winding and release cycle of first wheel set 7 and second wheel set 8 together, and/or which is comprised between 25% and 40%, and more particularly between 35% and 40%, of the angular amplitude corresponding to the cycle of winding and holding first wheel set 7 alone in the wound position.

In a variant, that can be cumulated with the preceding variant, the first path 301 is arranged at the periphery of a wheel 30 driven by motor means of the timepiece mechanism or comprised in said control device 100, and delaying means 4 includes at least one delay surface 40, which consists of a substantially tangential surface to said wheel 30, and an arc length of between 6 and 10% of the largest radius of wheel 30 with which radius the first lever 1 cooperates.

The first winding means for first wheel set 7 is arranged to create a first increasing phase 14, in which first lever 1 stores energy between a first torque consumption level 11 and a second torque consumption level 12 which is higher than first level 11. The second winding means for second wheel set 8 is arranged to create a first increasing phase 24 in which second lever 2 stores energy between a first torque consumption level 21 and a second torque consumption level 22, which is higher than first level 21. The delaying means 4 is arranged to create, during a second decreasing phase 15 of first lever 1 consecutive to first increasing phase 14, at least one stabilising stage 16 at a third, intermediate torque consumption level 13 between first torque consumption level 11 and second consumption level 12. At the end of the second decreasing phase 15, the first lever 1 transmits all of the energy that it has accumulated during the first increasing phase 14 to a mechanism using said energy, before or at the latest the moment at which the second lever 2 transmits all of the energy that it has accumulated during first increasing phase 24 to a user mechanism, so as to prevent a peak in torque consumption by cumulating the torque consumptions of each of first lever 1 and second lever 2.

The second winding means includes means for transmitting motor means comprised in the timepiece mechanism or control device 100 to a contact surface 10 including a second path 302 for controlling second lever 2. Contact surface 10 is movable via the action of said motor means for transmitting energy to levers 1 and 2 in the form of torque, in accordance with a sequence imposed by paths 301 and 302. In this sequence, each of levers 1 and 2 respectively changes, in succession, from first torque consumption level 11, 21 to second torque consumption level 12, 22, which is higher than first level 11, 21, during a first, increasing phase 14, 24, where lever 1, 2 stores energy, then from second level 12, 22 to first level 11, 21, during a second, decreasing phase 15, 25, in which the lever transmits energy to a mechanism using said energy.

Although the invention is illustrated here with a contact surface 10 at the periphery of a wheel 30, in other embodiments contact surface 10 is formed by a rack or set of attached racks, or contact surface 10 is formed by a sector with an elliptical geometry, including cam paths or teeth.

The invention is described more specifically below for the particular application to a striking work, illustrated by the Figures and which is in no way restrictive. In this case of a strike control mechanism, on mechanical control device 100 for the sequential control of at least a first strike lever 1 and a second strike lever 2 of a timepiece mechanism, the first lever 1 and second lever 2 are arranged for respectively controlling the movement of a first hammer 7 and a second hammer 8 for striking two blows that are close together in time. This sequential control device 100 includes first means for winding first hammer 7 and second means for winding second hammer 8. Control device 100 is arranged to release first hammer 7 and second hammer 8 in succession and not simultaneously.

According to the invention, the first winding means includes means 4 for delaying the time between the winding and release of first hammer 7, said means 4 being arranged for keeping potential energy accumulated in the mechanism for manoeuvring first hammer 7 for a determined time period, so as to keep first hammer 7 wound during said determined time period until the release thereof, thereby forming means for creating a time lag in the winding of first hammer 7.

These levers 1 and 2 are each arranged to cooperate with a path, 301 and 302 respectively, of a contact surface 10, comprised in control device 100. This contact surface 10 defines, via the paths at the rate of one path per lever, the sequence of movements imparted to the different levers. Contact surface 10 is movable via the action of motor means of the timepiece mechanism, or additional motor means that control device 100 may include. Indeed, control device 100 may be devised as an additional unit that can be juxtaposed with an existing movement. The first lever 1 and second lever 2 receive energy supplied by contact surface 10, in the form of torque, in accordance with a sequence imposed by paths 301 and 302 of contact surface 10.

In this sequence, each of levers 1 and 2 respectively changes, in succession, from a first torque consumption level 11, 21 respectively, which is preferably low or zero, to a second torque consumption level 12, 22 respectively, which is higher than first level 11, 21 respectively, during a first, increasing phase 14, 24 respectively, where it stores energy in the form of torque, then from second level 12, 22 respectively to first level 11, 21 respectively, during a second, decreasing phase 15, 25 respectively, in which it transmits energy to a mechanism using said energy. During this sequence, first lever 1 transmits all of the energy it has accumulated to a mechanism using said energy before or after the moment at which second lever 2 transmits all of the energy it has accumulated to a user mechanism.

According to the invention, this control device 100 includes delaying means 4, arranged to create, during the second, decreasing phase 15 of first lever 1, at least one stabilising stage 16 at a third, intermediate torque consumption level 13, between first and second torque consumption levels 11 and 12 of first lever 1, to prevent a peak in torque consumption by cumulating the torque consumptions of each lever.

The invention thus differs from known strike mechanisms which rely on "wolf teeth" type ratchet toothings, wherein the energy storage phase during the climb up the least steep slope of the tooth is followed, instantaneously, by an abrupt release of the energy corresponding to the steepest slope of the tooth.

In a preferred embodiment of the invention, the contact surface 10 defines the sequence such that torque consumption stabilising stage 16 of first lever 1 occurs during the first, increasing phase 24 of second lever 2.

Preferably, contact surface 10 defines the sequence such that, after second torque consumption decreasing phase 15 of first lever 1, a new first increasing phase 14 is started for a new manoeuvre of first lever 1, before second torque consumption decreasing phase 25 has finished.

Preferably, contact surface 10 defines the sequence such that the first torque consumption increasing phase 24 of second lever 2 is started after the first torque consumption increasing phase 14 of first lever 1 has finished.

The nature of delaying means 4 depends upon the mechanisms used. This description describes more specifically the case in which contact surface 10 is a set of cam paths at the periphery of a wheel, which is the most common configuration in horology. However, the invention applies in exactly the same way if the geometrical nature of the support for contact surface 10 is different, for example a linear support. Contact surface 10 could then take the form of a rack or a set of attached racks, or even a sector with a particular geometry, for example elliptical, including cam paths or teeth or other elements.

Likewise, the invention is described for a contact surface 10 that includes projecting elements forming cams for actuating the levers, but it may equally well be implemented with recessed elements, the cams then being formed by hollows or grooves along a profile.

Figure 3:
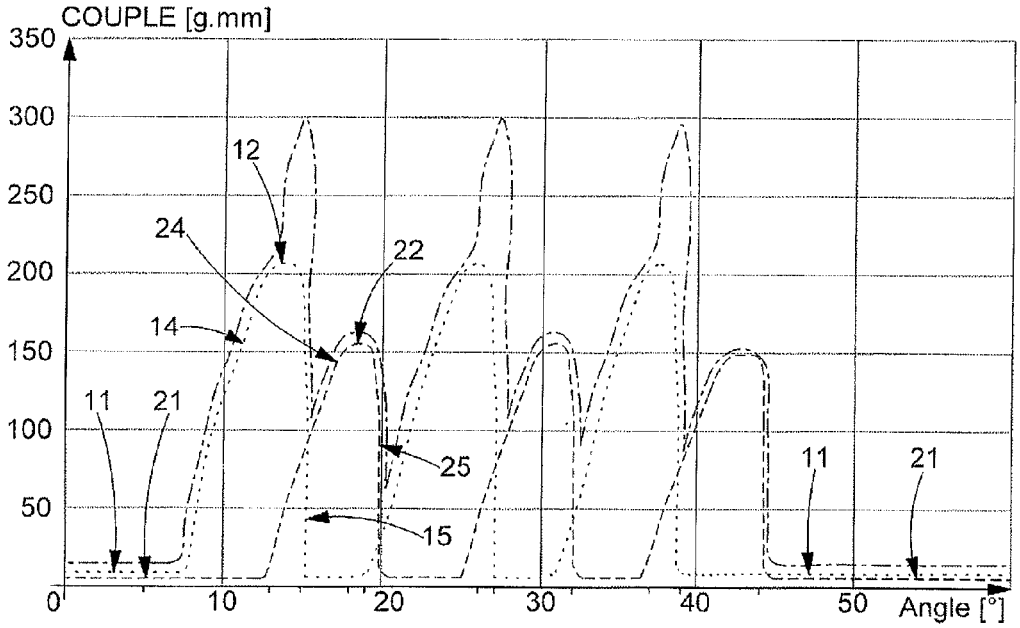
FIG. 3 is a diagram showing the torque consumption of each of the teeth of the strike wheel of FIG. 1 on the y axis, and the instantaneous cumulation thereof, according to the angular position of the strike wheel, on the x axis, and demonstrating the range of variation of the cumulated curve during execution of the strike.
Figure 6:
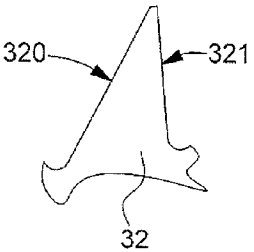
FIG. 6 is a similar diagram to FIG. 5 of a tooth of FIG. 1, or a tooth of another path of the strike wheel of FIG. 2.

The Figures illustrate a particular example of use of the invention, relating to a striking mechanism. FIGS. 1 and 3 illustrate a state-of-the-art example, known in particular from "MONTRES BREGUET SA" creations. Contact surface 10 is at the periphery of a strike wheel 30, driven by the motor means of a timepiece mechanism, and drives the sequence of movements of first lever 1 and second lever 2, which are pivotally mounted each about a parallel axis to that of wheel 30 and external thereto, via a first path 301 including at least a first control cam 31 for handling first lever 1, and via a second path 302, distinct from first path 301, and including at least a second control cam 32 for handling second lever 2. These control cams 31 and 32, known from the prior art, are made in the form of pointed teeth, as seen in FIG. 6.

For a sequential ding-dong type strike, repeated three times here in the example of FIGS. 1 and 3 relating to prior embodiments, the dotted lines in the diagram of FIG. 3 show that, starting from an idle state at first level 11 of low or zero torque consumption by first "ding" tooth 31, first lever 1 is wound starting from an angular position of 8° in the example of FIG. 3. The torque consumption of lever 1 increases up to second torque level 12, which constitutes its maximum level, at around 13°. The torque drops around 15°, when lever 1 is released and releases its energy transmitted to first hammer 7, for striking the first bell or gong 71. Consumption then drops back to first level 11, until rewinding at around 20°, where the sequence is repeated, then around 32°, where the sequence is repeated again.

In a similar manner, starting from an idle state at a first level 22 of low or zero torque consumption of the second "dong" tooth 32, second lever 2 is wound starting from an angular position of 13° in the example of FIG. 3 in the dashed line. The torque consumption level of this lever 2 increases up to second torque level 22, which constitutes its maximum level, at around 18°.The torque drops around 19°, when lever 2 is released and releases its energy transmitted to second hammer 8 for striking second gong 81. Consumption then drops back to second level 21, until rewinding around 26°, where the sequence is repeated, then around 39°, where the sequence is repeated again.

FIG. 3 shows that the curve in dot and dashed lines representing the cumulatation of torque consumption experiences significant variations, with a high peak around 15°/27°/39°, and a very low level around 20°/32°/44°. In this example, the second maximum level 12 corresponding to the first lever 1 of first "high" ding hammer 7 is 200 g.mm, and the second maximum level 22 corresponding to the second lever 2 of second "low" dong hammer 8 is 150 g.mm. The maximum level of the resulting curve is 300 g.mm, and is thus only slightly less than the sum of the maximum torques which is 350 g.mm.

When a strike mechanism strikes two close blows like this with two hammers, it is advantageous to wind the two hammers in succession rather than simultaneously, specifically to prevent any peak in instantaneous torque consumption. The invention implements a time shift in the winding of one of the hammers, and keeps the hammer wound until it is released. In the case illustrated in the Figures where the control mechanism is formed by a toothed wheel, the time shift in winding of one of the hammers is advantageously obtained by enlarging the corresponding tooth.

Figure 2:
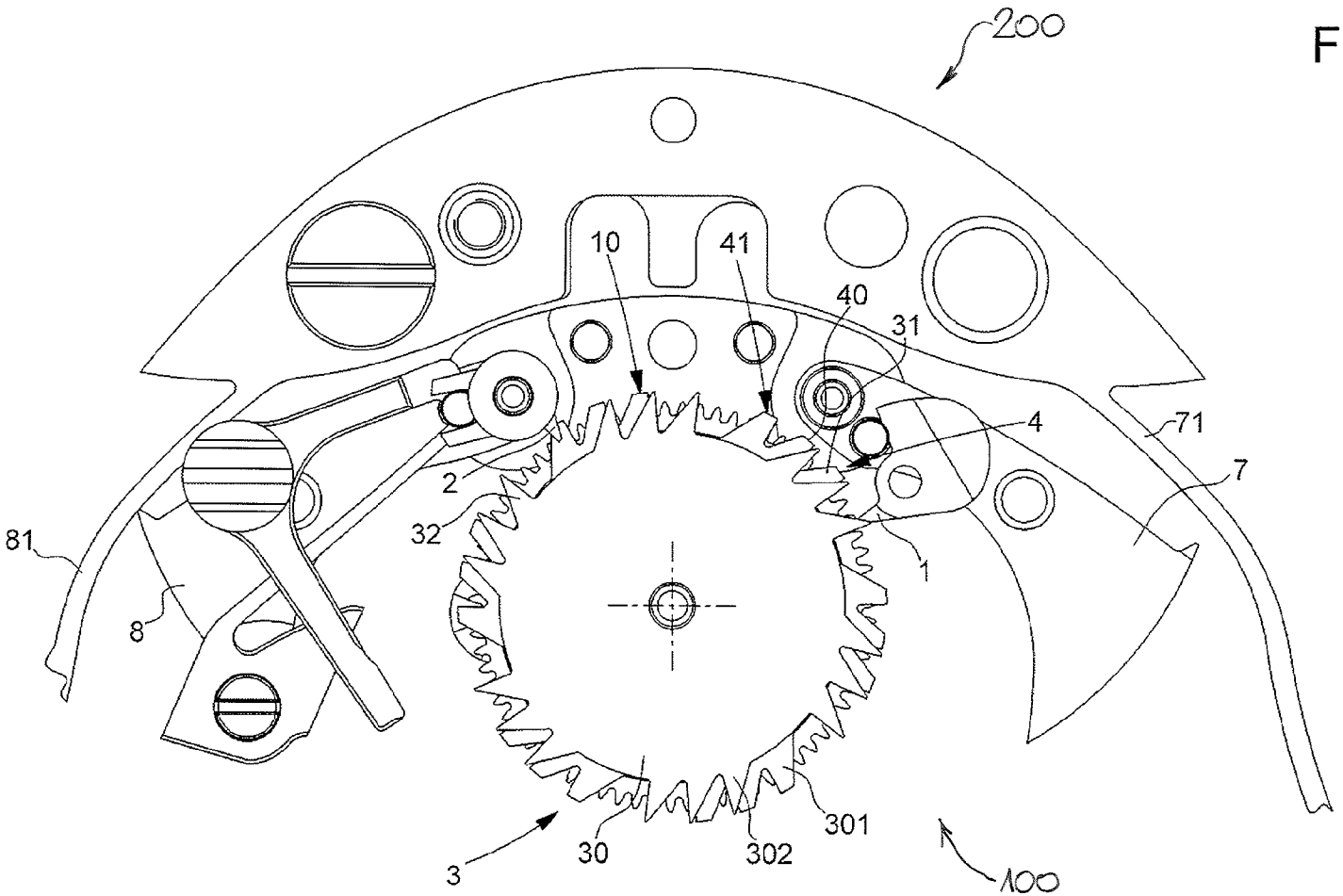
FIG. 2 is a similar diagram to FIG. 1, of a striking mechanism incorporating a mechanical sequential control device for at least two levers according to the invention, wherein one of the paths includes special teeth for causing a time lag in the winding of one of the hammers, and keeping it wound until it is released.
Figure 4:
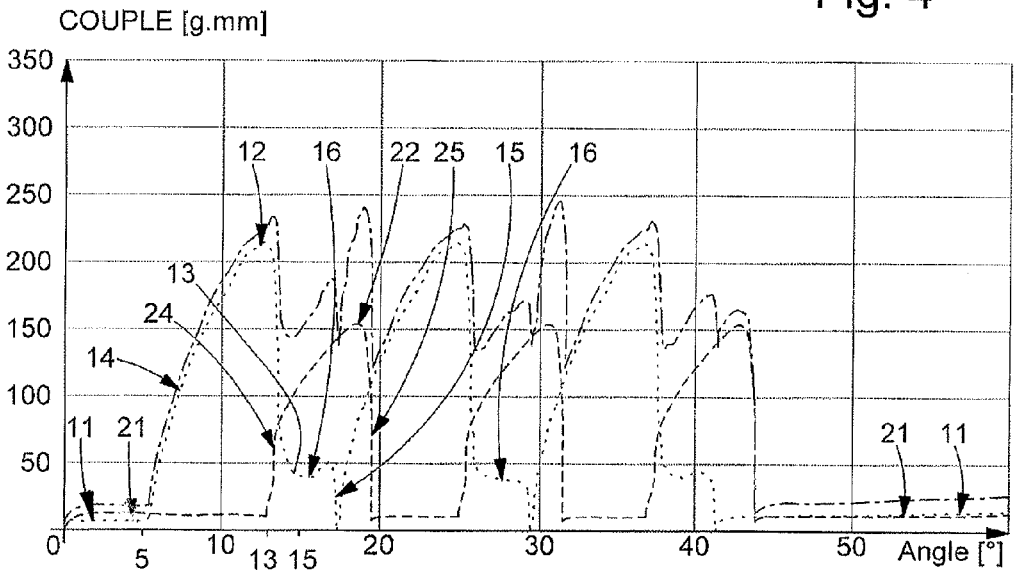
FIG. 4 is a similar diagram to FIG. 3, showing the torque consumptions of the teeth of the strike wheel of FIG. 2 according to the invention, and showing how the cumulation curve is smoothed out at a medium level during execution of the strike.
Figure 5:
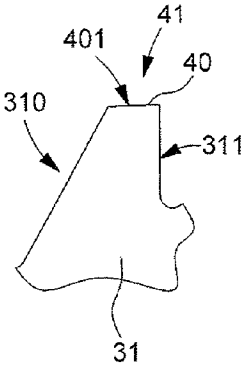
FIG. 5 is a partial schematic plan diagram of a tooth of a first path of the strike wheel of FIG. 2 according to the invention.

According to the invention, in a particular embodiment visible in FIGS. 2, 4 and 5, contact surface 10 is at the periphery of a wheel 30 driven by motor means of the timepiece mechanism, or by motor means comprised in control device 100. In the particular case of a striking mechanism and FIGS. 2 and 4, wheel 30 is a strike wheel.

Contact surface 10 drives the sequence of movements of first lever 1 and second lever 2 which are each pivotally mounted about a parallel axis to that of wheel 30 and external thereto. This driving occurs via a first path 301 including at least a first control cam 31 for manoeuvring first lever 1 and by a second path 302, distinct from first path 301, which includes at least a second control cam 32 for manoeuvring second lever 2. The example of FIG. 4 shows, on first path 301, three tooth-shaped cams 31 for controlling three "ding" sounds and, on second path 302, three tooth-shaped cams 32 for controlling three "dong" sounds. The arrangement of contact surface 10 defines the phase shift between the "ding" sounds and "dong" sounds, and the time interval between two consecutive ding-dongs. In this example, each strike sequence lets off three ding-dongs one after the other, and wheel 30 of the FIG. 4 example has six groups of cams each executing these three ding-dongs. The stop between one sequence of three ding-dongs and the next is achieved, for example, by a mechanism with pallets, not shown in the Figure, controlled by release means 3 of the watch mechanism, for example a motion-work or suchlike.

According to the invention, the first control cam 31 has a delay surface 40, which forms delaying means 4 or at least a part thereof if the means comprises multiple elements. In the example embodiment of FIG. 4, delay surface 40 is formed by a cylindrical sector whose axis merges with that of wheel 30 and forms the largest diameter thereof in the area of travel of first lever 1 and second lever 2, or via a flat surface substantially tangential to said cylindrical sector. Other embodiments, particularly with different profiles, are evidently possible without departing from the core of the invention.

Contact surface 10 has at least a first control cam 31 for manoeuvring first lever 1 and at least a second control cam 32 for manoeuvring second lever 2. Each control cam 31, 32 respectively, includes a first ramp 310, 311 respectively, for first increasing phase 14, 24 respectively, and a second ramp 320, 321 respectively, for at least the end of the second decreasing phase 15, 25 respectively. According to the invention, at least the first control cam 31 includes, between first ramp 310 and second ramp 320, an intermediate surface 401 forming delay means 4.

Figure 7:
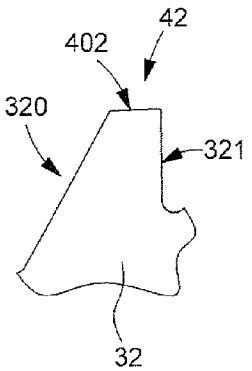
FIG. 7 is a similar diagram to FIG. 5 of a tooth of another path of the strike wheel of FIG. 2, in an alternative embodiment.

In a particular version that is not shown in the Figures, each control cam 31, 32 respectively, includes, between first ramp 310, 311 respectively and second ramp 320, 321 respectively, an intermediate surface 401, 402 respectively, forming delay means 4. This configuration may be useful, both for taking advantage of the accumulated torque saving achieved via the arrangement of first tooth 31 with intermediate surface 401, and also for adjusting the time interval between the "ding" and "dong" sounds to a determined value, by shifting said second strike via second intermediate surface 402, as visible in FIG. 7.

The FIG. 4 diagram of the embodiment according to the invention shows that, starting from an idle state at a first low or zero torque consumption level 11 of first "ding" tooth 31, the first lever 1 is wound from an angular position of 5° in this example, and the torque consumption of lever 1 increases to second torque level 12, which constitutes the maximum level thereof, around 13°.

The torque drops around 14°, around stabilising stage 16 at consumed torque level 13, when lever 1 cooperates with intermediate surface 401. Indeed, lever 1, which was cooperating with the first ramp 310 during torque increasing phase 14, then comes onto intermediate surface 401, and the orientation of the resulting force changes, and thus the moment of torque also changes. The intermediate torque level 13 is a holding torque on the tooth, at this stage lever 1 has completely wound hammer 7. In the version where the intermediate surface 401 is on a concentric radius to the centre of rotation, the torque is regular. Naturally, it is possible to make profiled teeth to further decrease the accumulated torque oscillation, but FIG. 4, which shows the results of experiments, verifies that the accumulated torque is regular with the very simple solution consisting in enlarging the first tooth, with a cylindrical external surface.

Later, around angular value 17°, when lever 1 is released and releases its energy transmitted to first hammer 7 to strike the first bell or gong 71, consumption drops back down to the first level 11, until winding occurs, almost immediately in this example, when the sequence is repeated, then around 29° where the sequence is repeated again.

In a similar manner, starting from an idle state at a first low or zero torque consumption level 21 of second "dong" tooth 32, second lever 2 is wound from an angular position of 13° in the example of FIG. 4, and the torque consumption of this lever 2 increases to second torque level 22, which constitutes its maximum level, around 18°. The torque drops around 19°, when lever 2 is released and releases its energy transmitted to the second hammer 8 to strike the second bell or gong 81. Consumption then drops back to first level 21, until rewinding around 26°, when the sequence is repeated, and then around 37°, when the sequence is repeated again.

In the example embodiment illustrated in the Figures, delaying means 4 includes at least one delay surface 40 with sufficiently large amplitude. Indeed, the angular amplitude during which first hammer 7 remains wound is preferably comprised between 15% and 25% of the angular amplitude corresponding to the complete cumulated winding and release cycle of the two hammers 7 and 8, and/or comprised between 25% and 40%, preferably between 35% and 40% of the angular amplitude corresponding to the cycle of winding and holding first hammer 7 in a wound position. FIG. 4 shows that the curve representing the accumulation of torque consumption experiences small variations, spread out between 130 and 250 g.mm, during the entire strike sequence. In this example, the second maximum level 12 corresponding to first lever 1 of first "high" ding hammer 7 is 215 g.mm, and the second maximum level 22 corresponding to second lever 2 of the second "low" dong hammer 8 is 155 g.mm, The maximum level of the resulting curve is 250 g.mm, and is thus considerably lower than the sum of the maximum torques which is 370 g.mm. It is clear that the maximum torque level 22 corresponding to the second lever could be much higher than it is, without much altering the result, since the torque consumption of the two levers are in a way in phase opposition owing to the delay stage on the first tooth.

Figure 8:
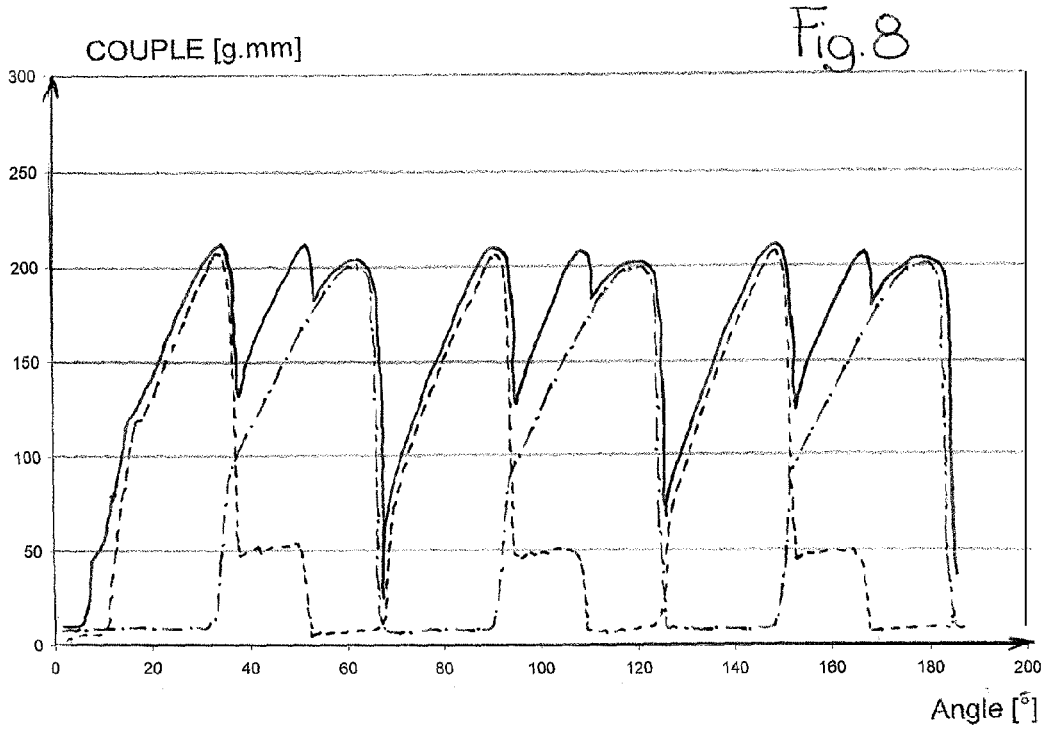
FIG. 8 is a similar diagram to FIG. 4, showing the torque consumptions of the teeth of the strike wheel of FIG. 2 according to the invention, with another optimised adjustment.
Figure 9:
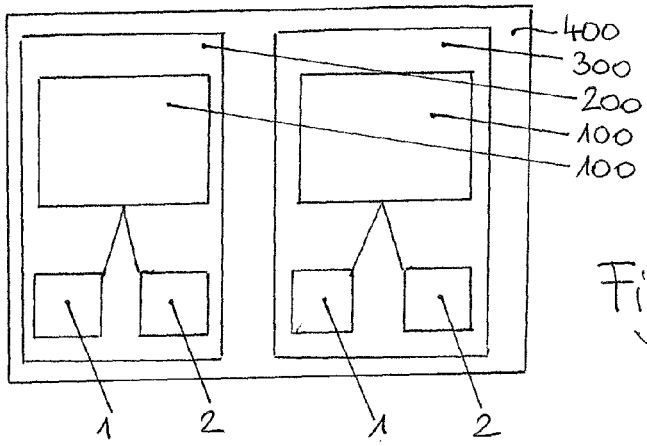
FIG. 9 is a block-diagram showing a timepiece including a striking mechanism and a date mechanism each including a control device according to the invention.

FIG. 8 illustrates another adjustment, corresponding to an angular amplitude of the delaying area, which is adjusted to around 36% of the angular amplitude corresponding to the cycle of winding and holding first hammer 7 in a wound position, whereas the difference in radius between the minimum value and maximum value travelled by first lever 1 during a strike cycle, is on the order of 7% of the maximum radius on which delay surface 40 is located. The ratio between the delay arc length on delay surface 40 on the one hand and the increase in radius during the strike cycle on the other hand, is close to 50%.

The release of the first hammer (in dotted lines) occurs after the delaying stages, at angles 53°, 110°, 167°, whereas the release of the second hammer (dot and dash lines) occurs at values 68°, 125°, 182°, i.e. a difference of 15° between the strike of the first hammer and the second hammer and a difference of 42° between each cycle.

The torque taken here is equivalent for both hammers, with a maximum of approximately 200 g×mm.

The drop in torque is significant, when the first toothing reaches the flat, which corresponds to a torque of around 50 g×mm, this gives a cumulated torque (in full lines) that does not exceed the value of each separate torque, i.e. 200 g×mm, therefore preventing wasted energy consumption. The lowest value of the cumulated torque is around 25 g×mm here, when the second hammer is released and just before the torque is taken from the first toothing.

Naturally, it is also possible to limit this cumulated torque to a still lower value, for example comprised between 120 and 200 g×mm. Indeed, the lower the cumulated torque, the closer it comes to a constant torque consumption value, which is easier to regulate.

Thus the torque taken by the strike work does not have any significant peaks due to the addition of the torques from the two hammers.

The object is therefore achieved, which is to have a smoothed out torque with the lowest possible delta, which in this case means fewer problems for properly regulating the strike work.

In short, in the version applying to a striking mechanism, contact surface 10 is located at the periphery of a strike wheel 30, and the first lever 1 and second lever 2 are each arranged to actuate at least one hammer 7, 8 respectively, on at least one bell or gong 71, 81 respectively, via the action of as many teeth 31, 32, respectively as strike wheel 30 has, and which, completed by intermediate pads having no contact with first lever 1 and second lever 2, constitute surface contact 10. The hammers may also strike a pin-barrel or similar element.

The invention also concerns a strike mechanism including at least one strike wheel using part of the energy supplied by an energy source to actuate at least one hammer on at least one gong, via action of a tooth or cam comprised in said strike wheel on said hammer, and including at least one such control device 100, This control device 100 is a sequential strike control device, the first lever 1 is a first strike lever, the second lever 2 is a second strike lever of a timepiece mechanism. The first wheel set 7 is a first hammer and the second wheel set 8 is a second hammer 8, the first lever 1 and second lever 2 are arranged for respectively controlling the movement of first hammer 7 and hammer 8 to strike two blows close together in time and contact surface 10 is situated at the periphery of a strike wheel 30. The first lever 1 and second lever 2 are each arranged to actuate at least one hammer 7; 8 on at least one gong 71; 81, via the action of as many teeth 31; 32 as strike wheel 30 includes and which form contact surface 10, completed by intermediate pads with no contact with first lever 1 and second lever 2.

Another advantageous application of the invention concerns a date mechanism including a control device 100 of this type, including delaying means 4 which includes at least one delay surface 40, on contact surface 10 which winds in succession at least a first lever 1 and a second lever 2 which are comprised in the pivoting elements of a date mechanism, or which control the movement of such pivoting elements.

According to a particular feature, this date mechanism is an instantaneous date mechanism which includes several pivoting elements, which are wound in series by different levers, and which jump simultaneously.

The invention further concerns a timepiece including at least one such control device 100, and including a timepiece mechanism, which has motor means and release means 3 for controlling actuation of at least a first lever 1 and a second lever 2. This timepiece includes at least one such control device 100, for regulating the torque consumed by a strike mechanism or a minute repeater mechanism comprised in said timepiece, and/or for regulating the torque consumed by a date mechanism comprised in said timepiece.

What is claimed is:

1. A mechanical device for the sequential control of at least a first lever and a second lever of a timepiece mechanism, the first lever and the second lever being arranged for respectively controlling the movement of a first wheel set and a second wheel set, against elastic return means, to make two movements that are partially superposed, the control device including first means for winding the first wheel set and second means for winding the second wheel set, the control device being arranged to release the first wheel set and the second wheel set in succession and not simultaneously, wherein the first winding means includes means delaying the time between the winding and the release of the movement of the first wheel set, arranged for keeping potential energy accumulated in the mechanism for manoeuvring the first wheel set for a determined time period, so as to keep the first wheel set wound for the determined time period until the release thereof, and also wherein the first winding means includes means for transmitting motor means, comprised in the timepiece device or the control device, to a contact surface including a first path, for controlling the first lever, and on which is arranged at least one delay surface forming the delaying means.

2. The control device according to claim 1, wherein the first path is arranged at the periphery of a wheel driven by motor means of the timepiece mechanism or by motor means comprised in the device, and wherein the delaying means includes at least one delay surface which has an angular amplitude, during which the first wheel set remains wound, which is comprised between 15% and 25% of the angular amplitude corresponding to the complete cumulated winding and release cycle of the first wheel set and second wheel set, and/or which is comprised between 25% and 40% of the angular amplitude corresponding to the cycle of winding and holding the first wheel set in a wound position.

3. The control device according to claim 1, wherein the first path is arranged at the periphery of a wheel driven by motor means of the timepiece mechanism or by motor means comprised in the device, and wherein the delaying means includes at least one delay surface, which consists of a substantially tangential surface to the wheel, and an arc length comprised between 6% and 10% of the largest radius of the wheel with which radius the first lever cooperates.

4. The control device according to claim 1, wherein the first winding means for the first wheel set is arranged to create a first increasing phase in which the first lever stores energy between a first torque consumption level and a second torque consumption level which is higher than the first level, and wherein the second winding means for the second lever is arranged to create a first increasing phase in which the second lever stores energy between a first torque consumption level and a second torque consumption level, which is higher than the first lever, and wherein the delaying means is arranged to create, during a second decreasing phase of the first lever consecutive to the first increasing phase, at least one stabilising stage at a third intermediate torque consumption level between the first torque consumption level and the second torque consumption level, and wherein, at the end of the second decreasing phase, the first lever transmits all of the energy that it has accumulated during the first increasing phase to a mechanism that uses the energy, before or at the latest the moment at which the second lever transmits all of the energy that it has accumulated during the first increasing phase to a user mechanism, so as to prevent a peak in torque consumption by cumulating the torque consumptions of each of the first and second levers.

5. The control device according to claim 4, wherein the second winding means includes means for transmitting motor means, comprised in the timepiece mechanism or the control device, to a contact surface including a second path for controlling the second lever, the contact surface being movable via the action of motor means to transmit energy to the levers in the form of torque, in a sequence imposed by the paths in which each of the levers changes in succession from the first torque consumption level to the second torque consumption level, which is higher than the first level during a first increasing phase in which the lever stores energy, then from the second level to the first level during a second decreasing phase in which the lever transmits energy to a mechanism that uses the energy.

6. The control device according to claim 5, wherein the contact surface defines the sequence such that the torque consumption stabilising stage of the first lever occurs during the first increasing phase of the second lever.

7. The control device according to claim 5, wherein the contact surface defines the sequence such that, after the second torque consumption decreasing phase of the first lever, a new increasing phase for a new manoeuvre of the first lever is started before the second torque consumption decreasing phase of the second lever has finished.

8. The control device according to claim 5, wherein the contact surface defines the sequence such that the first torque consumption increasing phase of the second lever is started after the first torque consumption increasing phase of the first lever has finished.

9. The control device according to claim 5, wherein the contact surface is at the periphery of a wheel, driven by the motor means of the timepiece mechanism or by motor means comprised in the device, and wherein the contact surface drives the sequence of movements of the first lever and the second lever, which are pivotally mounted each about a parallel axis to the axis of the wheel and external thereto, via a first path including at least a first control cam for manoeuvring the first lever, and via a second path distinct from the first path and including at least a second control cam for manoeuvring the second lever, the first control cam including a delay surface constituting the delaying means.

10. The control device according to claim 9, wherein the delay surface is formed by a cylindrical sector, whose axis merges with that of the wheel and which constitutes the largest diameter of the wheel in the area of travel of the first lever and second lever, or by a flat surface substantially tangential to such a cylindrical sector.

11. The control device according to claim 5, wherein the contact surface includes at least a first control cam for manoeuvring the first lever and at least a second control cam for manoeuvring the second lever, each the control cam including a first ramp for the first, increasing phase and a second ramp for at least the end of the second, decreasing phase, and at least the first control cam including, between the first ramp and the second ramp, an intermediate surface forming the delaying means.

12. The control device according to claim 5, wherein the contact surface includes at least a first control cam for manoeuvring the first lever and at least a second control cam for manoeuvring the second lever, each the control cam including a first ramp for the first, increasing phase and a second ramp for at least the end of the second, decreasing phase, and, between the first ramp and the second ramp, an intermediate surface forming the delaying means.

13. The control device according to claim 1, wherein the contact surface is formed by a rack or set of attached racks, or in that the contact surface is formed by a sector with an elliptical geometry, including cam paths or teeth.

14. A striking mechanism including at least one strike wheel using part of the energy supplied by an energy source to actuate at least one hammer on at least one gong, via the action of a tooth or cam comprised in the strike wheel on the hammer, and including at least one control device according to claim 1, wherein the control device is a sequential strike control device, wherein the first lever is a first strike lever, the second lever is a second strike lever of a timepiece mechanism, the first wheel set is a first hammer and the second wheel set is a second hammer, the first lever and second lever being arranged for respectively controlling the movement of the first hammer and the second hammer, for striking two blows close together in time, and further wherein the contact surface is located at the periphery of a strike wheel, and wherein the first lever and second lever are each arranged to actuate at least one hammer on at least one gong, via the action of as many teeth as the strike wheel possesses, and which, completed by intermediate pads having no contact with the first lever and second lever, form the contact surface.

15. A date mechanism including a control device according to claim 1, including delaying means comprising at least one delay surface on a contact surface, which winds, in succession, at least a first lever and a second lever which are comprised in pivoting elements of a date mechanism, or which control the movement of such pivoting elements.

16. The date mechanism according to claim 15, wherein the date mechanism is an instantaneous date mechanism which includes several pivoting elements wound in succession by different levers, and wherein all of the pivoting elements jump simultaneously.

17. A timepiece including a timepiece mechanism, which includes motor means and release means for controlling actuation of at least a first lever and a second lever, wherein it includes at least one control device according to claim 1 for regulating the torque consumed by a strike mechanism or a minute repeater strike mechanism comprised in the timepiece, and/or for regulating the torque consumed by a date mechanism comprised in the timepiece.

* * * * *